US009010883B2

(12) United States Patent
Scott

(10) Patent No.: US 9,010,883 B2
(45) Date of Patent: Apr. 21, 2015

(54) FOOD SHIELD HAVING A SINGLE-SIDED LOCKING MECHANISM

(71) Applicant: Advance Tabco, Inc., Edgewood, NY (US)

(72) Inventor: Steven Jamie Scott, Rocky Point, NY (US)

(73) Assignee: Advance Tabco, Inc., Edgewood, NY (US)

( * ) Notice: Subject to any disclaimer, the term of this patent is extended or adjusted under 35 U.S.C. 154(b) by 0 days.

(21) Appl. No.: 14/190,583

(22) Filed: Feb. 26, 2014

(65) Prior Publication Data

US 2014/0265757 A1 Sep. 18, 2014

Related U.S. Application Data

(60) Provisional application No. 61/779,353, filed on Mar. 13, 2013.

(51) Int. Cl.
*A47F 9/00* (2006.01)
*A47F 10/06* (2006.01)

(52) U.S. Cl.
CPC ..... *A47F 10/06* (2013.01); *A47F 2010/065* (2013.01)

(58) Field of Classification Search
CPC ..... A47F 10/06; A47F 2010/065
USPC ..... 312/137, 140.1, 140.3, 140.4, 326
See application file for complete search history.

(56) References Cited

U.S. PATENT DOCUMENTS

| | | | | |
|---|---|---|---|---|
| 6,588,863 | B1 * | 7/2003 | Yatchak et al. | 312/140.4 |
| 7,040,723 | B2 * | 5/2006 | Matus, Jr. | 312/140.4 |
| 7,895,953 | B2 * | 3/2011 | Matus, Jr. | 108/27 |
| 8,109,579 | B2 * | 2/2012 | English et al. | 312/137 |
| 8,585,160 | B2 * | 11/2013 | Atkins | 312/137 |
| 2006/0192467 | A1 * | 8/2006 | Matus | 312/140.4 |
| 2007/0236112 | A1 * | 10/2007 | Williman | 312/140.4 |
| 2011/0169384 | A1 * | 7/2011 | Padden et al. | 312/140.4 |

* cited by examiner

*Primary Examiner* — Daniel Rohrhoff
(74) *Attorney, Agent, or Firm* — Gerald T. Bodner

(57) ABSTRACT

A food shield for use in a restaurant or food service institution includes a transparent panel, a locking, panel support assembly and a non-locking, panel support assembly. The locking, panel support assembly is mounted on a first vertical support member, and the non-locking, panel support assembly is mounted on a second vertical support member. A first lateral side portion of the transparent panel is affixed to the locking, panel support assembly, and an opposite second lateral side portion of the transparent panel is affixed to the second lateral side portion of the transparent panel. The transparent panel is adjustable in a plurality of angular dispositions, and is locked in one of the angular dispositions by the locking, panel support assembly, and is not locked in one of the angular dispositions by the non-locking panel support assembly.

11 Claims, 7 Drawing Sheets

FOOD SHIELD HAVING A SINGLE-SIDED LOCKING MECHANISM

CROSS-REFERENCE TO RELATED APPLICATIONS

This application is related to U.S. Provisional Application Ser. No. 61/779,353, filed on Mar. 13, 2013, and entitled "Food Shield Having a Single-Sided Locking Mechanism", the disclosure of which is incorporated herein by reference and on which priority is hereby claimed.

BACKGROUND OF THE INVENTION

1. Field of the Invention

The present invention generally relates to equipment used in restaurants and other food service institutions where food is displayed, and more particularly relates to a food shield or barrier through which food served by such an institution may be viewed by a customer.

2. Description of the Prior Art

There are numerous health and safety codes with which restaurants and other food service institutions must comply. One or more of such codes require that food displayed by the food service institution or restaurant be separated from a customer by a barrier. In many self-service food establishments, the food is uncovered when displayed, and an adjustable transparent barrier is provided between the food and the customer, which allows the customer to see the displayed food but does not unduly restrict the customer's access to the food so that he may make his selection. Such barriers are commonly referred to in the food service industry as "sneeze guards", because they aid in preventing contamination of the displayed food by airborne bacteria transmitted by the customer. One would commonly find such food barriers at self-service salad bars or food buffets in a restaurant.

There are a wide variety of food shields or "sneeze guards" used in the food service industry today, and many of these include a transparent panel, such as an acrylic or glass pane, supported by two or more vertical posts on opposite lateral sides of the transparent panel, and connected to the posts by locking mechanisms or assemblies which permit the panel to be adjusted in height on the posts as well as at a desired angle.

One of the problems with conventional food shields is that, to effect their position on the posts or their angular disposition, the locking mechanisms on both sides of the transparent panel must be adjusted simultaneously. Thus, an employee or owner of the food establishment in which such a food shield is used must reach across the width of the transparent panel and use both hands to make the adjustment. These transparent panels may be four feet, or more, in width, making it difficult for one individual to adjust both locking mechanisms simultaneously, and sometimes requiring two persons to adjust the locking mechanism on each side of the panel.

OBJECTS AND SUMMARY OF THE INVENTION

It is an object of the present invention to provide a food shield mounted on vertical posts which is easily adjustable from only one lateral side of the food shield.

It is another object of the present invention to provide a locking mechanism or assembly for use with a food shield, which locking mechanism allows the transparent panel of the food shield to be adjustably locked in a particular angular disposition between vertical supporting posts.

It is still another object of the present invention to provide a food shield having a transparent panel, a locking mechanism on one lateral side of the transparent panel, and a non-locking mechanism on the other lateral side of the transparent panel, where the angle of the transparent panel may be easily adjusted from only one lateral side thereof.

It is yet a further object of the present invention to provide a food shield which overcomes the inherent disadvantages of conventional food shields.

In one form of the present invention, a food shield includes a transparent panel, such as an acrylic or glass pane, a locking mechanism or assembly connected to and supporting one lateral side of the transparent panel, and a non-locking mechanism or assembly connected to and supporting the opposite lateral side of the transparent panel. Each of the locking and non-locking mechanisms is mountable to a respective vertical support post. Both the locking mechanism and the non-locking mechanism allow the transparent panel to be adjusted in its angular disposition between the support posts and locked into a desired position by the locking mechanism.

More specifically, the locking, panel support assembly includes a chamber barrel having an end face in which is formed a plurality of holes or detents formed about the circumference thereof. A pull collar which is biased by a compression spring in a direction towards the end face of the chamber barrel includes a locating pin mounted thereon. The locating pin is receivable in any one hole or detent formed in the end face of the chamber barrel. By pulling outwardly on the pull collar against the bias of the compression spring, the locating pin of the pull collar may be dislodged from a particular hole or detent in the end face of the chamber barrel. The transparent panel may then be adjusted angularly between the two support posts. The pull collar is then released against the bias of the spring, and the locator pin is received in a different hole or detent on the end face of the chamber barrel to lock the transparent panel in a desired angular disposition between the support posts.

The non-locking assembly supports the other lateral side of the transparent panel. The non-locking, panel support assembly also includes a chamber barrel, but the barrel need not include holes or detents formed in its end face, and no locator pin is provided so that the non-locking assembly freely rotates with angular movement of the transparent panel effected from just the other lateral side of the panel.

Accordingly, the food shield of the present invention advantageously allows the transparent panel to be adjusted angularly on the support posts from only one lateral side thereof, unlike conventional food shields.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
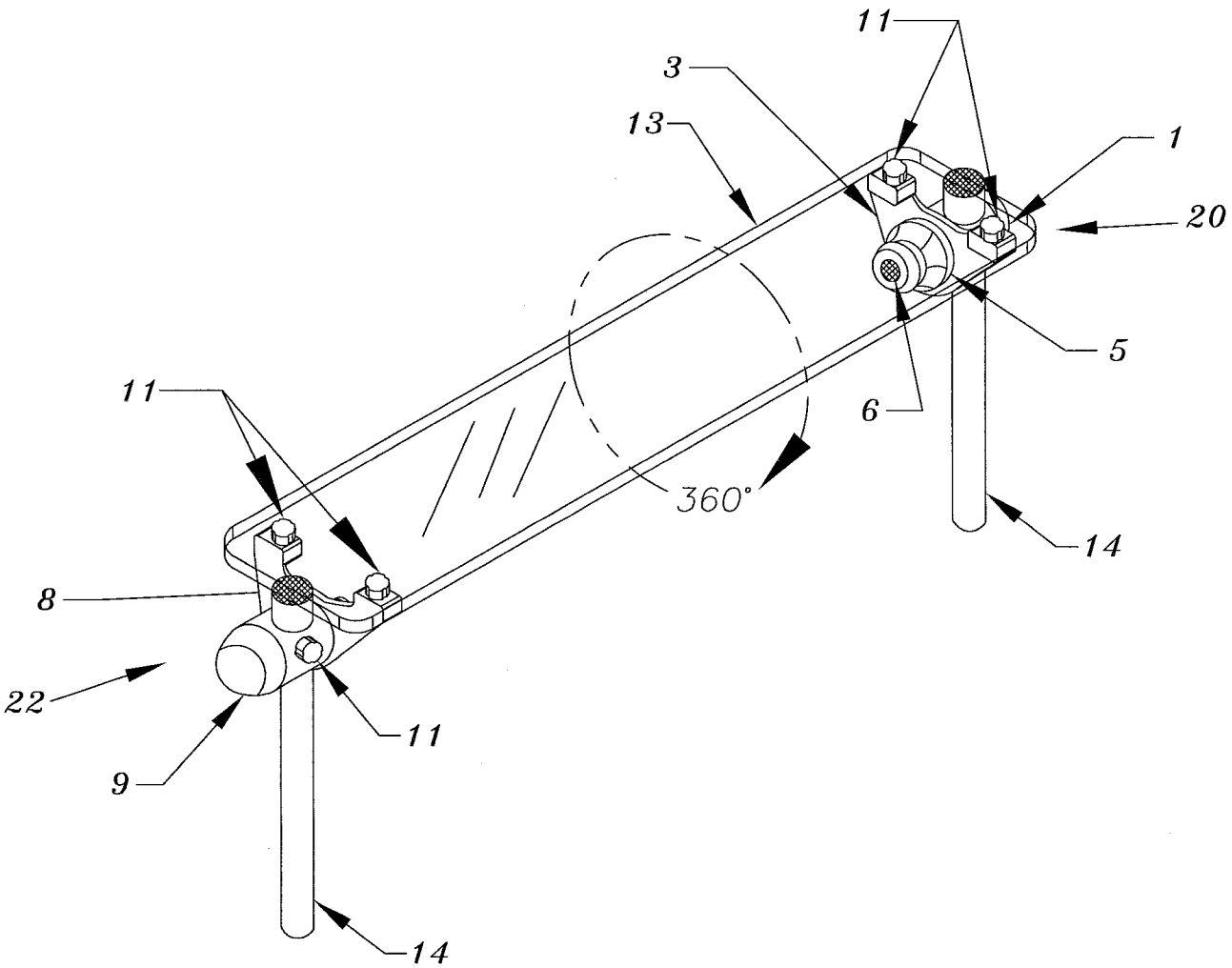
FIG. 1 is a perspective view of a food shield formed in accordance with the present invention.

Referring initially to FIG. 1 of the drawings, it will be seen that a food shield, also commonly referred to in the food service industry as a "sneeze guard", constructed in accordance with the present invention includes a transparent panel 13, which may be formed from a framed or unframed planar sheet of clear acrylic material or safety or tempered glass. The transparent panel 13 is mounted on and supported by a locking assembly 20 on one lateral side thereof, and is mounted on and supported by a non-locking assembly 22 on the opposite lateral side thereof. The locking, panel support assembly 20 and the non-locking, panel support assembly 22 are mounted to respective vertical support posts 14, with the transparent panel 13 essentially extending horizontally between the support posts 14. The locking and non-locking assemblies 20, 22 of the food shield are positioned at a desired height along the axial length of the support posts 14, and permit the transparent panel 13 to be adjusted angularly in a desired position, so as to best serve the requirements of the restaurant or food service establishment in which it is located in preventing contamination of food displayed on one side of the transparent panel 13 from airborne bacteria transmitted by customers on the opposite side of the panel, and yet not unduly restrict the customers' access to the food, if so desired.

Figure 2:
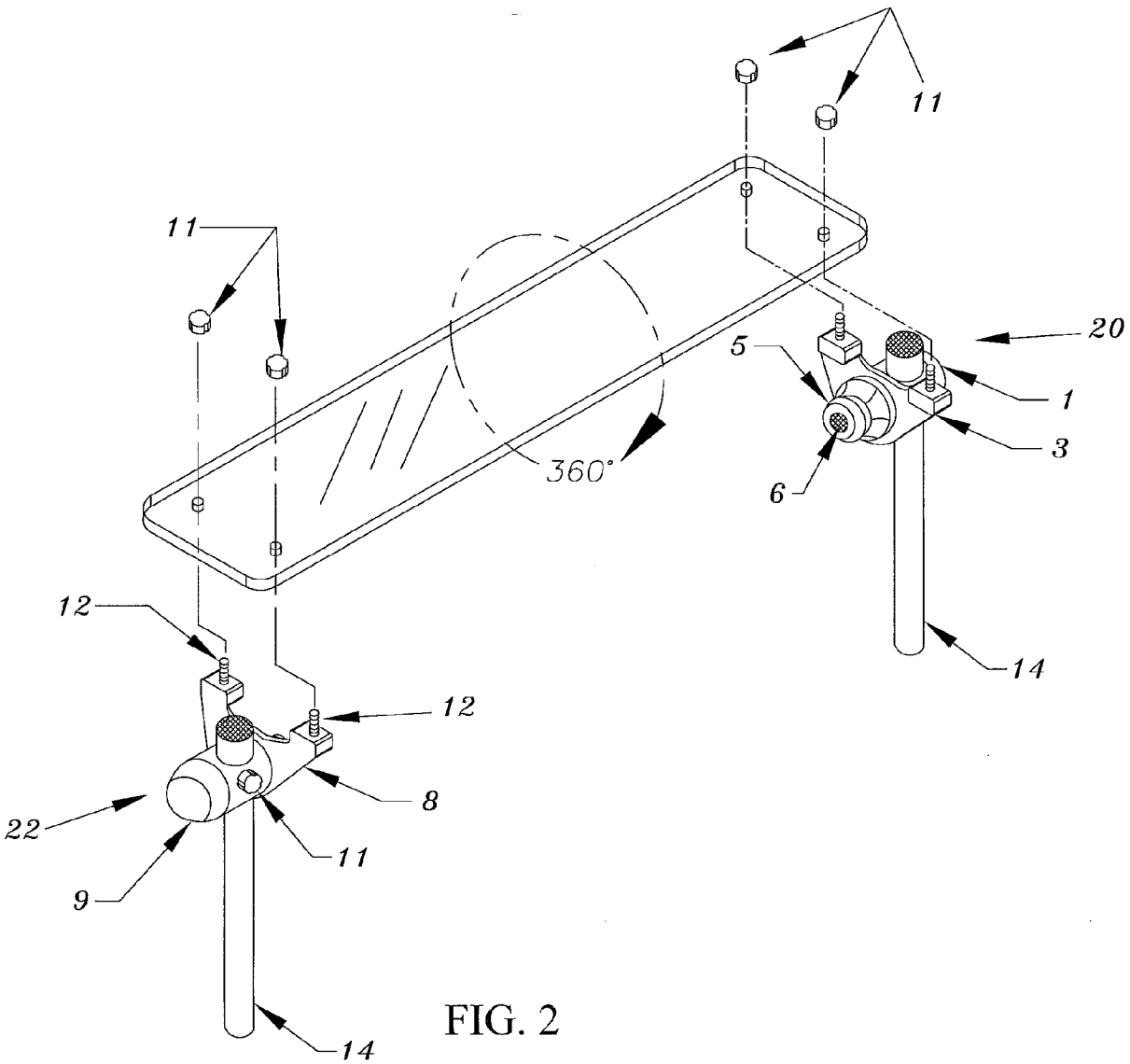
FIG. 2 is a partially exploded perspective view of the food shield of the present invention shown in FIG. 1.
Figure 3:
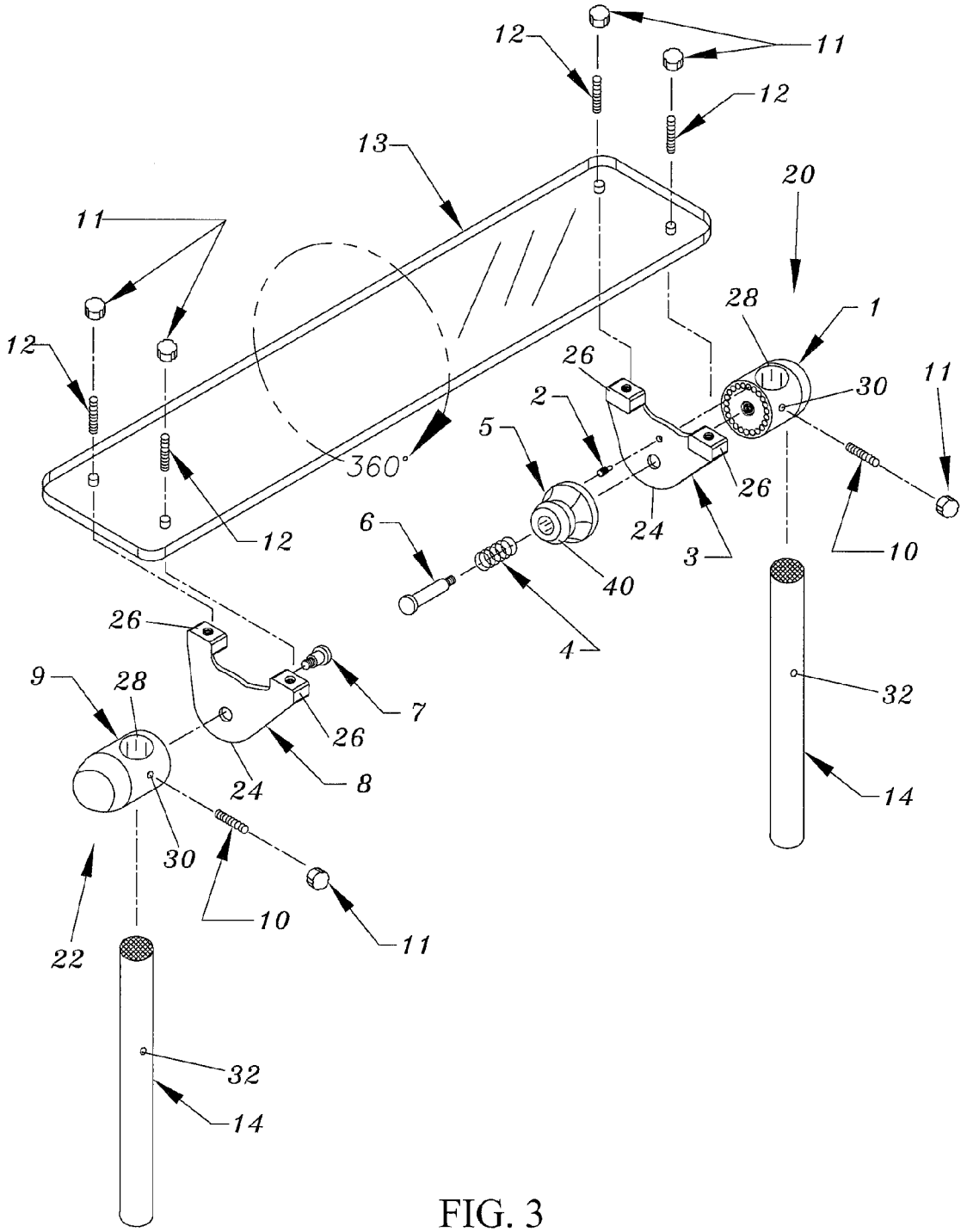
FIG. 3 is a fully exploded perspective view of the food shield of the present invention shown in FIGS. 1 and 2.

As can be seen from FIG. 2 of the drawings, each of the locking assembly 20 and non-locking assembly 22 includes a panel support bracket 3, 8, respectively, on which the transparent panel 13 is mounted. More specifically, a pair of holes is formed through the thickness of the transparent panel 13 on each lateral side portion of the panel. The holes receive threaded studs 12 extending outwardly from each of the brackets 3, 8. Threaded knobs 11 are screwed onto the ends of the studs 12 that extend through the transparent panel 13 to secure the panel to the support brackets 3, 8 of the locking and non-locking assemblies 20, 22.

FIGS. 3-9 of the drawings show the components of the food shield of the present invention in greater detail. The locking assembly 20 includes a pull collar 5, a locking chamber barrel 1, and a panel support bracket 3 interposed between the pull collar 5 and the locking chamber barrel 1. The panel support bracket 3 includes a planar main body 24, and two spaced apart support flanges 26 extending perpendicularly outwardly from a surface of one side of the main body 24. Each flange 26 includes a threaded bore formed in its upper surface. Each threaded bore receives a threaded stud 12, which is used for securing the transparent panel 13 to the support bracket 3 of the locking assembly 20.

The non-locking assembly 22 also includes a panel support bracket 8, and a non-locking chamber barrel 9. The panel support bracket 8 of the non-locking assembly 22 is similar in shape and structure to the shape and structure of the support bracket 3 of the locking assembly 20, and also includes a planar main body 24 and two spaced apart support flanges 26 extending perpendicularly outwardly from a surface of one side of the planar main body 24, so that the flanges 26 of the panel support bracket 8 of the non-locking assembly 22 face the flanges 26 of the panel support bracket 3 of the locking assembly 20.

Each of the locking chamber barrel 1 and the non-locking chamber barrel 9 of the locking assembly 20 and the non-locking assembly 22, respectively, is generally cylindrical in shape, and each includes a first bore 28 passing diametrically through the thickness of the barrel. The first bore 28 is dimensioned to receive one of the vertical support posts 14 so that the locking chamber barrel 1 and the non-locking chamber barrel 9 may be mounted on a respective support post 14 at a desired position along the axial length thereof.

Also, each of the locking chamber barrel 1 and the non-locking chamber barrel 9 respectively of the locking assembly 20 and the non-locking assembly 22 has a second bore 30 formed therein which radially extends from the exterior surface of the barrel into the first, larger diameter bore 28 which receives the support post 14. This second, smaller diameter bore 30, which is disposed perpendicularly to the first bore 28, is threaded and receives a threaded stud 10. A knob 11 is threadingly secured to an exposed axial free end of each of the threaded studs 10. The knobs 11 may be turned to advance the threaded studs 10 into the barrels 1, 9 and so that the other axial end of each stud 10 extends into the support post bore 28 of each barrel.

The vertical support posts 14 may include one or more holes 32 formed therein along their axial lengths. The barrels 1, 9 of the locking and non-locking assemblies 20, 22 may be positioned on their respective support posts 14 such that the second bores 30 formed in the barrels are in alignment with a selected hole 32 formed in the support posts 14. The knobs 11 are then turned to advance the threaded studs 10 into a corresponding hole 32 formed in the support posts 14 to secure the locking and non-locking assemblies 20, 22 of the food shield to their respective support posts 14 on which they are mounted.

Figure 4:
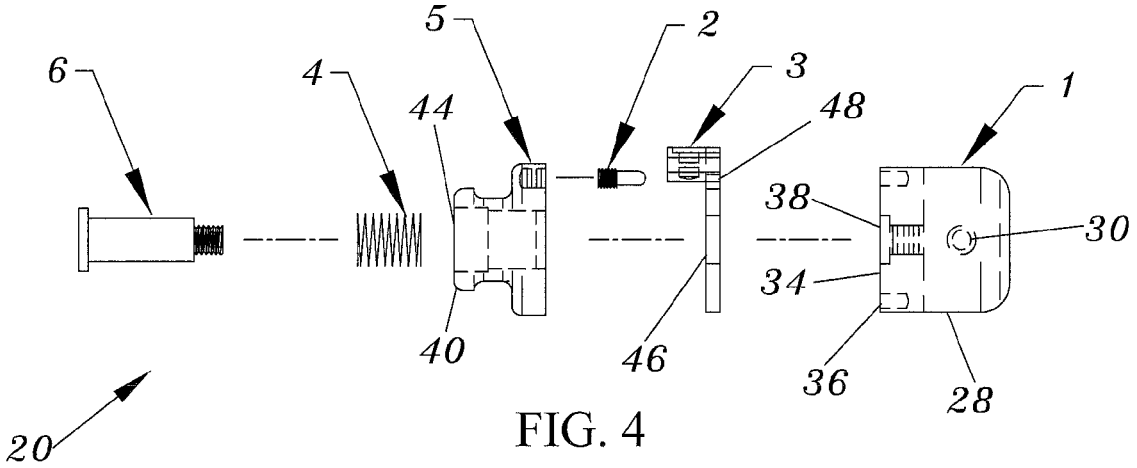
FIG. 4 is a side view of a locking, panel support assembly forming part of the food shield of the present invention.
Figure 6:
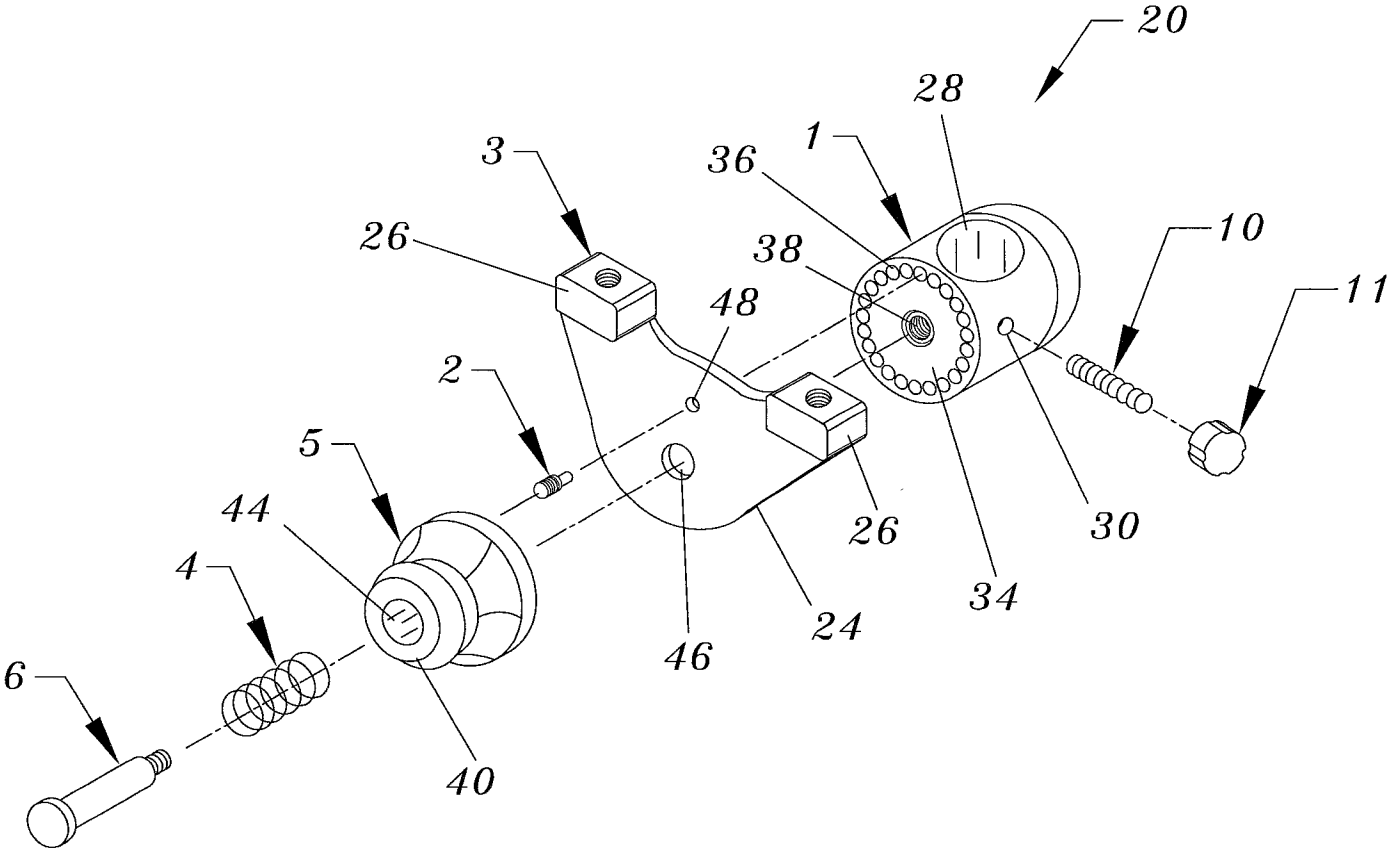
FIG. 6 is an exploded, front perspective view of the locking assembly forming part of the food shield of the present invention.
Figure 7:
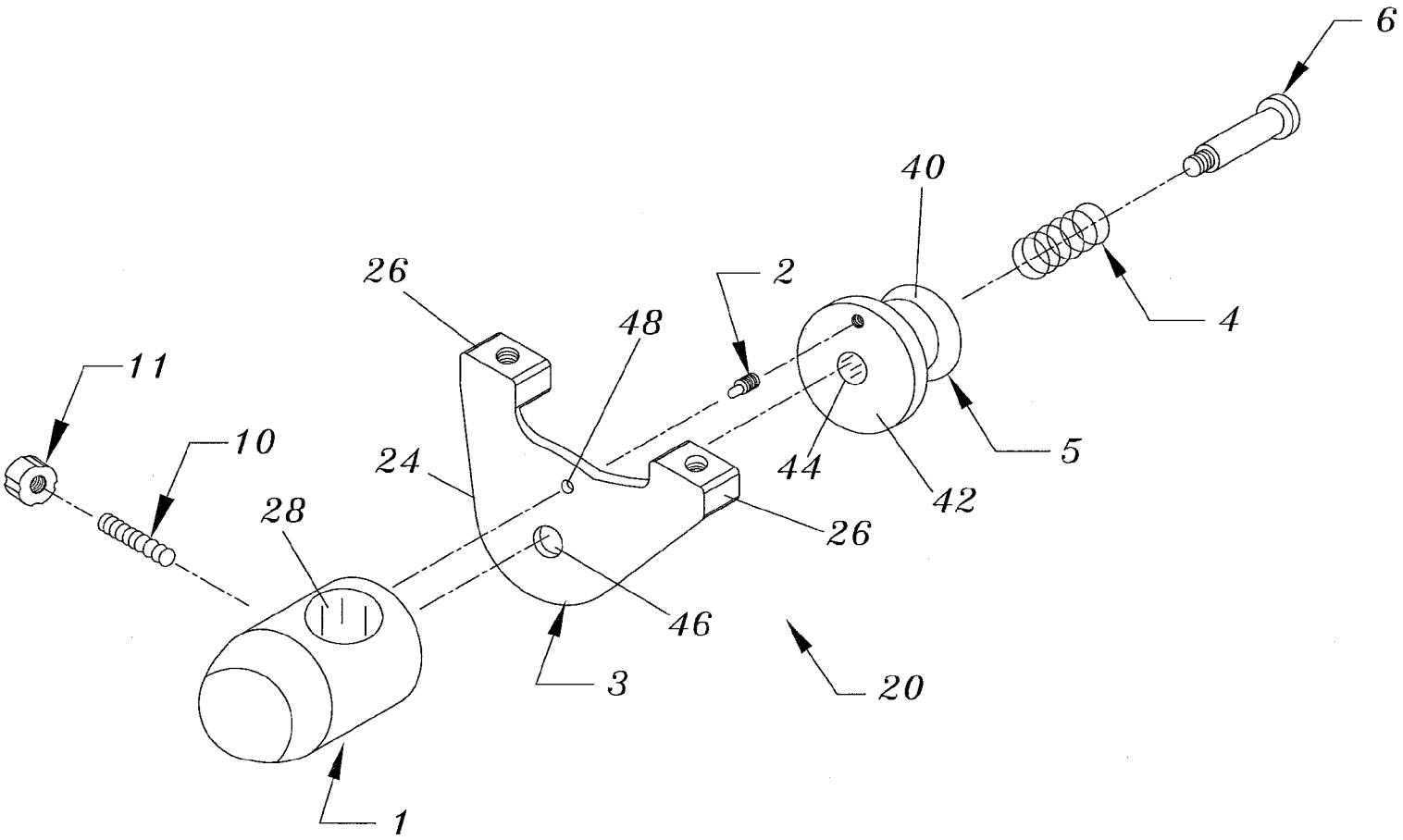
FIG. 7 is an exploded, rear perspective view of the locking assembly forming part of the food shield of the present invention.

The locking, panel support assembly 20 of the food shield will now be described in greater detail, and reference should be had to FIGS. 4, 6 and 7 of the drawings. Here, it will be seen that the chamber barrel 1 of the locking assembly 20 includes a flat end face 34. A plurality of closely spaced detents or openings 36 is formed circumferentially in the end face 34 near the peripheral edge of the end face. There is also a threaded central opening 38 formed in the end face 34 of the chamber barrel 1.

The pull collar 5 of the locking assembly 20 is shaped with a knob-like axial end 40 so that it is easily graspable by a user of the food shield. The pull collar 5 also includes a flat end face 42 axially opposite the knob-like end 40. Mounted on the flat end face 42 of the pull collar 5 is a locating pin 2 which extends outwardly therefrom. Also, the pull collar 5 has a central bore 44 extending axially therethrough.

The panel support bracket 3 is sandwiched between the flat end face 34 of the chamber barrel 1 and the flat end face 42 of the pull collar 5. The main body 24 of the panel support bracket 3 has two openings formed through its thickness. A first opening 46 receives a relatively long shoulder bolt 6 to secure the components of the locking assembly 20 together. A smaller diameter second opening 48, formed through the thickness of the bracket 3, allows the free end of the locating pin 2 that is mounted on the pull collar 5 to pass freely therethrough.

The unthreaded shank of the long shoulder bolt 6 passes centrally through a compression spring 4, through the central bore 44 of the pull collar 5 and through the larger, first opening 46 formed in the main body 24 of the panel support bracket 3. The threaded free end portion of the long shoulder bolt 6 is received by the threaded central opening 38 formed in the end face 34 of the chamber barrel 1 of the locking assembly 20. The shoulder bolt 6 secures the pull collar 5, panel support bracket 3 and locking chamber barrel 1 of the locking assembly 20 together, but allows the pull collar 5 to move reciprocatingly axially on the unthreaded shank of the shoulder bolt 6 against the bias of the compression spring 4, which is held captive between the head of the shoulder bolt 6 and the pull collar 5.

The locking assembly 20 operates in the following manner. The locating pin 2 situated on the end face 34 of the pull collar 5 passes through the smaller diameter second opening 48 formed through the main body 24 of the panel support bracket 3, and the free end of the locating pin 2 is received in one of the detents or openings 36 formed circumferentially in the flat end face 34 of the locking chamber barrel 1. To adjust the angular disposition of the transparent panel 13 of the food shield with respect to the vertical support posts 14 between which the food shield is mounted, the user would grasp the knob end 40 of the pull collar 5 and pull outwardly on the collar in an axial direction away from the chamber barrel 1 against the bias of the compression spring 4. The shank of the long shoulder bolt 6 is particularly dimensioned in axial length so that the pull collar 5 can only move axially a predetermined distance thereon so as not to permit the locating pin 2 from becoming disassociated with the panel support bracket 3. The locating pin 2, mounted on the flat end face 42 of the pull collar 5, freely passes through the smaller diameter second opening 48 formed in the main body 24 of the panel support bracket 3 and moves reciprocatingly therein with axial movement of the pull collar 5. Thus, when the user pulls on the pull collar 5, the free end of the locating pin 2 mounted thereon becomes dislodged from a particular opening or detent 36 formed in the flat end face 34 of the locking chamber barrel 1, and yet remains within the locating pin opening 48 formed in the panel support bracket 3.

Now, the user may adjust the angular disposition of the transparent panel 13 by rotating it relative to the vertical support posts 14 between which the transparent panel 13 of the food shield of the present invention is mounted. When the transparent panel 13 is moved to a desired position, the user releases the pull collar 5 so that the pull collar, biased by the compression spring 4, will move axially on the shank of the long shoulder bolt 6 toward the chamber barrel 1, and the free end of the locating pin 2 will be received in an aligned opening or detent 36 formed in the flat end face 34 of the chamber barrel 1. The engagement of the locating pin 2 with a particular opening or detent 36 in the chamber barrel 1 will lock the transparent panel 13 in a desired angular disposition between the vertical support posts 14. This adjustment is accomplished from only one side of the transparent panel 13.

The threaded end portion of the shoulder bolt 6 has a reduced diameter than that of the unthreaded shank. The reduced diameter threaded end portion of the bolt 6 defines a shoulder with the larger diameter shank. The opening 46 formed in the panel support bracket 3 which receives the bolt 6 is dimensioned so that the support bracket 3 is retained on the bolt 6 but may rotate on the shank thereof. The bolt 6 is screwed into the central opening 38 formed in the chamber barrel 1 until the shoulder abuts against a recessed portion of the end face 34 of the barrel surrounding the central opening 38.

Figure 5:
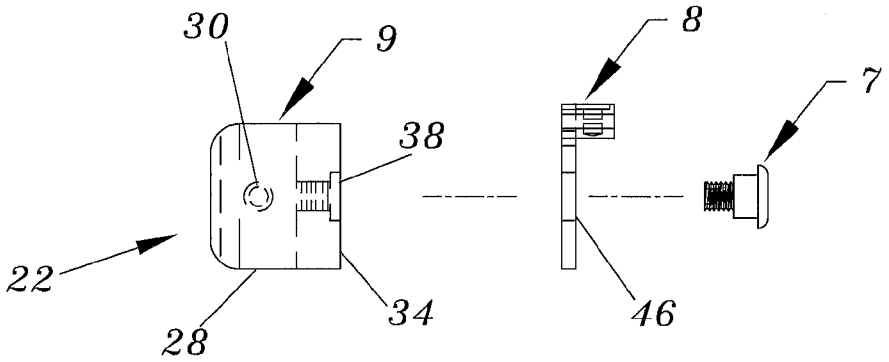
FIG. 5 is a side view of a non-locking, panel support assembly forming part of the food shield of the present invention.
Figure 9:
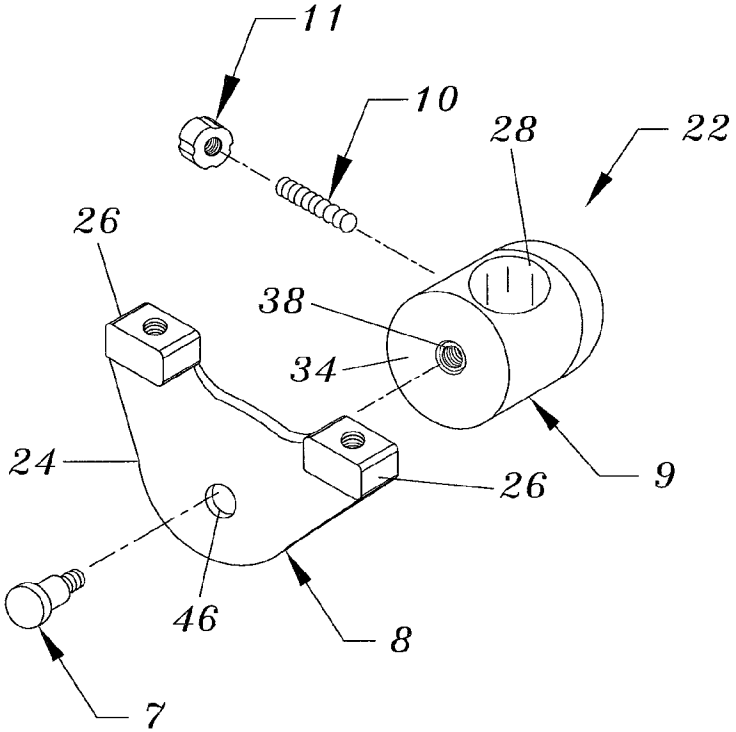
FIG. 9 is an exploded, rear perspective view of the non-locking assembly forming part of the food shield of the present invention.
Figure 8:
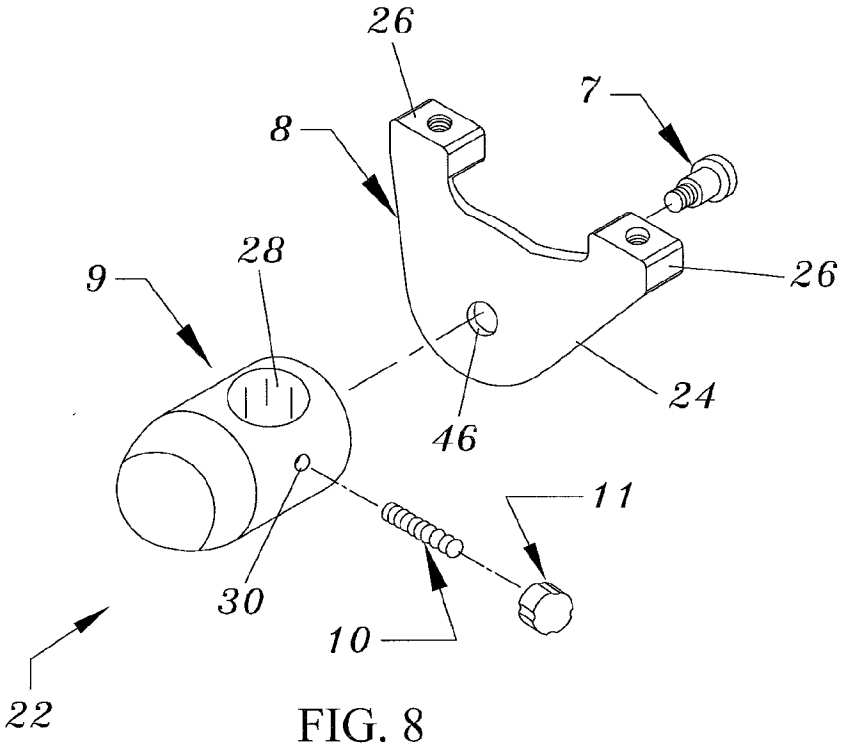
FIG. 8 is an exploded, front perspective view of the non-locking assembly forming part of the food shield of the present invention.

The non-locking, panel support assembly 22 mounted on the other vertical support post 14 and situated on the other lateral side of the transparent panel 13 of the food shield, opposite to where the locking assembly 20 and support post 14 on which the locking assembly is mounted, will now be described, and reference should be had to FIGS. 5, 8 and 9 in this regard. The non-locking assembly 22 includes a non-locking chamber barrel 9 and a panel support bracket 8, as mentioned previously. The non-locking chamber barrel 9 has generally the same cylindrical shape as the locking chamber barrel 1 of the locking assembly 20, as described previously, with a support post bore 28 formed diametrically through the side of the chamber barrel 9, and a smaller, threaded stud bore 30 disposed perpendicularly to the support post bore 28 and formed radially through the barrel 9 from the side wall thereof and into the support post bore 28. A threaded stud 10 is received by the stud bore 30 to extend into the support post bore 28 and be received by a hole 32 formed in the vertical support post 14 on which the non-locking chamber barrel 9 is mounted. The exposed, free end of the threaded stud 10 is capped with a threaded knob 11 for grasping by the user of the food shield so as to advance the threaded stud 10 into the chamber barrel 9 and the hole 32 in the support post 14 on which the non-locking assembly 22 is mounted. The structure of the stud 10, knob 11, support post bore 28 and stud bore 30 on the non-locking chamber barrel 9 of the non-locking, panel support assembly 22 is preferably the same as that of the components 10, 11, 28, 30 on the locking chamber barrel 1 of the locking, panel support assembly 20.

The panel support bracket 8 of the non-locking assembly 22 is generally the same as the panel support bracket 3 of the locking assembly 20, with a planar main body 24 and spaced apart flanges 26 extending perpendicularly from a side surface of the bracket 8 and on which one lateral side of the transparent panel 13 rests. As also mentioned previously, the flanges 26 on the support bracket 8 of the non-locking assembly 22 face the flanges 26 on the support bracket 3 of the locking assembly 20.

There is an opening 46 formed through the thickness of the main body 24 of the panel support bracket 8 of the non-locking assembly 22. Through this opening 46 is received a shoulder bolt 7, which is shorter in axial length than the shoulder bolt 6 used in the locking assembly 20. The shoulder bolt 7 has a threaded free end having a reduced diameter than that of the non-threaded shank of the bolt 7 so as to define with the shank a shoulder. The diameter of the opening 46 formed through the thickness of the panel support bracket 8 is such that it may receive the unthreaded shank of the shoulder bolt 7 and be rotatable thereon.

The threaded free end of the shoulder bolt 7 is received by a threaded central opening 38 formed in a flat end face 34 of the chamber barrel 9 of the non-locking assembly 22 and secured thereto, with the shoulder tightly abutting a recessed portion of the end face 34 of the chamber barrel 9 which surrounds the central opening 38 so that the panel support bracket 8 is secured to the flat end face 34 of the chamber barrel 9 but rotatable thereon to allow angular movement of the transparent panel 13 of the food shield mounted on the support bracket 8.

On the non-locking assembly 22, the panel support bracket 8 preferably does not include a locating pin bore 48, and the flat end face 34 of the non-locking chamber barrel 9 preferably does not include the detents or openings 36 found on the chamber barrel 1 of the locking assembly 20 for receiving a locating pin 2. Furthermore, there is no pull collar 5 or locating pin 2 on the non-locking assembly 22. Of course, the panel support bracket 8 and chamber barrel 9 of the non-locking assembly 22 could be made with the same structure as the bracket 3 and barrel 1 of the locking assembly 20 by including a locating pin bore 48 and a plurality of detents or openings 36 respectively formed therein, as long as a locating pin 2 is not used.

Accordingly, when the collar 5 of the locking assembly 20 is pulled outwardly from the panel support bracket 3 to disengage the locating pin 2 from an opening or detent 36 formed in the end face 34 of the locking chamber barrel 1, in order to adjust the angular disposition of the transparent panel 13, the panel support bracket 8 of the non-locking assembly 22, attached to the transparent panel 13 on its opposite lateral side, will freely rotate with the panel on the non-locking chamber barrel 9. When the locating pin 2 is received in an aligned opening or detent 36 formed in the chamber barrel 1 of the locking assembly 20, to secure the transparent panel 13 in a desired angular disposition with respect to the vertical support posts 14 between which the food shield of the present invention is mounted, the panel support bracket 8 of the non-locking assembly 22 will also remain in this new position on the chamber barrel 9 of the non-locking assembly 22, and will provide support to the transparent panel 13 on the lateral side of the transparent panel 13 opposite the lateral side where the locking assembly 20 is located.

As described above, one of the advantages of the food shield of the present invention is that adjustment of the angular disposition of the transparent panel 13 may be effected from only one lateral side of the panel. There is no need with the food shield of the present invention to unlock the support post mechanisms on both sides of the transparent panel 13 simultaneously, as is required with conventional food shields. One person may easily adjust the angular disposition of the food shield of the present invention from only one side of the transparent panel 13.

Also, the simplified structure of the locking assembly 20 of the food shield of the present invention, with its pull collar 5 and locating pin 2 that is selectively receivable in a detent or opening of the plurality of detents or openings 36 formed in the end face 34 of the chamber barrel 1, makes it easier for an employee or owner of the food service establishment to adjust the angle of the transparent panel 13. Very little pulling force is required to be exerted on the pull collar 5 to disengage the locating pin 2 from one of the openings or detents 36 formed in the end face 34 of the chamber barrel 1, against the bias of the compression spring 4, and the compression spring 4 will bias the locating pin 2 into a desired opening or detent 36 in the chamber barrel 1 when the pull collar 5 is released. Of course, it should be realized that two locking assemblies 20 may be used to support the lateral sides of the transparent panel 13 instead of one locking assembly 20 on one panel side and a non-locking assembly 22 on the other panel side, but then the adjustment of the angular disposition of the food shield would have to be made from both lateral sides of the transparent panel 13.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A food shield for use in a restaurant or food service institution, which comprises:

a transparent panel having a first lateral side portion and a second lateral side portion situated opposite the first lateral side portion;

a locking, panel support assembly for mounting on a first vertical support member, the locking, panel support assembly being affixed to the first lateral side portion of the transparent panel; and a non-locking, panel support assembly for mounting on a second vertical support member, the non-locking, panel support assembly being affixed to the second lateral side portion of the transparent panel;

wherein the transparent panel is adjustable in a plurality of angular dispositions relative to and between the locking, panel support assembly and the non-locking, panel support assembly;

wherein the non-locking, panel support assembly supports the second lateral side portion of the transparent panel and allows the adjustment of the angular disposition of the transparent panel without locking the transparent panel in one of the plurality of angular dispositions;

wherein the locking, panel support assembly supports the first lateral side portion of the transparent panel, allows the adjustment of the angular disposition of the transparent panel and selectively locks the transparent panel in one of the plurality of angular dispositions so that the angular disposition of the transparent panel may be adjusted to and locked in one of the plurality of angular dispositions from only the first lateral side portion of the transparent panel;

wherein the locking, panel support assembly includes:

a first panel support bracket on which the first lateral side portion of the transparent panel is mounted;

a locking chamber barrel; and a pull collar, the first panel support bracket being interposed between the locking chamber barrel and the pull collar;

wherein the locking chamber barrel has an end face in which is formed a plurality of openings arranged in a circular pattern on the end face; and wherein the pull collar includes an end face which is disposed to face the end face of the locking chamber barrel, and a locating pin, the locating pin being mounted on and extending outwardly from the end face of the pull collar in a direction toward the end face of the locking chamber barrel, the locating pin being selectively receivable by one opening of the plurality of openings formed in the end face of the locking chamber barrel.

2. A food shield as defined by claim 1, wherein the first panel support bracket includes a generally planar main body portion, the planar main body portion being situated between the end face of the pull collar and the end face of the locking chamber barrel, the planar main body portion of the first panel support bracket having a first opening formed through the thickness thereof, the first opening movably receiving the locating pin of the pull collar, the locating pin having a free end which passes through the first opening formed in the first panel support bracket and is selectively received in one opening of the plurality of openings formed in the end face of the locking chamber barrel.

3. A food shield as defined by claim 2, wherein the locking panel support assembly further includes a first fastener for fastening together the pull collar, the first panel support bracket and the locking chamber barrel;

wherein the planar main body portion of the first panel support bracket of the locking, panel support assembly further includes a second opening formed through the thickness thereof;

wherein the pull collar of the locking, panel support assembly includes a bore formed axially therethrough;

wherein the end face of the locking chamber barrel of the locking, panel support assembly includes at least a partial first bore formed centrally therein; and wherein the bore of the pull collar, the second opening of the first panel support bracket and the at least partial bore of the locking chamber barrel are situated in alignment with one another, the first fastener passing through the bore of the pull collar and the second opening of the first panel support bracket and being at least partially received by the at least partial first bore of the locking chamber barrel, the pull collar and the first panel support bracket being selectively rotatable relative to the locking chamber barrel when the locating pin is not received in one opening of the plurality of openings formed in the end face of the locking chamber barrel.

4. A food shield as defined by claim 3, wherein the locking, panel support assembly further includes a compression spring, the compression spring being mounted on the first fastener and being received by the axial bore of the pull collar, the compression spring biasing the pull collar and the locating pin situated thereon in a direction toward the end face of the locking chamber barrel such that the locating pin is biased by the compression spring to be received in one opening of the plurality of openings formed in the end face of the locking chamber barrel.

5. A food shield as defined by claim 4, wherein the pull collar of the locking, panel support assembly includes a knob end situated thereon axially opposite the end face of the pull collar, the knob end being graspable by a user to effect axial movement of the pull collar on the first fastener and to effect a selective engagement and disengagement of the locating pin mounted on the pull collar with one opening of the plurality of openings formed in the end face of the locking chamber barrel.

6. A food shield as defined by claim 1, wherein the locking chamber barrel of the locking, panel support assembly includes a bore formed diametrically therethrough for receiving the first vertical support member and for mounting the locking, panel support assembly on the first vertical support member.

7. A food shield as defined by claim 1, wherein the non-locking, panel support assembly includes:

a second panel support bracket on which the second lateral side portion of the transparent panel is mounted; and a non-locking chamber barrel, the second panel support bracket being mounted on the non-locking chamber barrel and being rotatable relative thereto.

8. A food shield as defined by claim 7, wherein the non-locking chamber barrel of the non-locking, panel support assembly has an end face, the end face having at least a partial first bore formed centrally therein;

wherein the second panel support bracket of the non-locking, panel support assembly includes a generally planar main body portion, the planar main body portion being situated in proximity to the end face of the non-locking chamber barrel, the planar main body portion of the second panel support bracket having an opening formed through the thickness thereof, the opening in the second panel support bracket being situated in alignment with the at least partial first bore formed in the end face of the non-locking chamber barrel; and wherein the non-locking, panel support assembly further includes a second fastener for fastening together the second panel support bracket and the non-locking chamber barrel, the second fastener passing through the opening of the second panel support bracket and being at least partially received by the at least partial first bore of the non-locking chamber barrel.

9. A food shield as defined by claim 8, wherein the non-locking chamber barrel of the non-locking, panel support assembly includes a second bore formed diametrically therethrough for receiving the second vertical support member and for mounting the non-locking, panel support assembly on the second vertical support member.

10. A food shield for use in a restaurant or food service institution, which comprises:

a transparent panel having a first lateral side portion and a second lateral side portion situated opposite the first lateral side portion;

a locking, panel support assembly for mounting on a first vertical support member, the locking, panel support assembly being affixed to the first lateral side portion of the transparent panel; and a non-locking, panel support assembly for mounting on a second vertical support member, the non-locking, panel support assembly being affixed to the second lateral side portion of the transparent panel;

wherein the transparent panel is adjustable in a plurality of angular dispositions relative to and between the locking, panel support assembly and the non-locking, panel support assembly;

wherein the non-locking, panel support assembly supports the second lateral side portion of the transparent panel and allows the adjustment of the angular disposition of the transparent panel without locking the transparent panel in one of the plurality of angular dispositions;

wherein the locking, panel support assembly supports the first lateral side portion of the transparent panel, allows the adjustment of the angular disposition of the transparent panel and selectively locks the transparent panel in one of the plurality of angular dispositions so that the angular disposition of the transparent panel may be adjusted to and locked in one of the plurality of angular dispositions from only the first lateral side portion of the transparent panel;

wherein the non-locking, panel support assembly includes:

a second panel support bracket on which the second lateral side portion of the transparent panel is mounted; and a non-locking chamber barrel, the second panel support bracket being mounted on the non-locking chamber barrel and being rotatable relative thereto;

wherein the non-locking chamber barrel of the non-locking, panel support assembly has an end face, the end face having at least a partial first bore formed centrally therein;

wherein the second panel support bracket of the non-locking, panel support assembly includes a generally planar main body portion, the planar main body portion being situated in proximity to the end face of the non-locking chamber barrel, the planar main body portion of the second panel support bracket having an opening formed through the thickness thereof, the opening in the second panel support bracket being situated in alignment with the at least partial first bore formed in the end face of the non-locking chamber barrel; and wherein the non-locking, panel support assembly further includes a second fastener for fastening together the second panel support bracket and the non-locking chamber barrel, the second fastener passing through the opening of the second panel support bracket and being at least partially received by the at least partial first bore of the non-locking chamber barrel.

11. A food shield as defined by claim 10, wherein the non-locking chamber barrel of the non-locking, panel support assembly includes a second bore formed diametrically therethrough for receiving the second vertical support member and for mounting the non-locking, panel support assembly on the second vertical support member.

* * * * *